US006394318B1

(12) United States Patent
Klodzinski

(10) Patent No.: US 6,394,318 B1
(45) Date of Patent: May 28, 2002

(54) DEVICE FOR MOUNTING A PUMP ON THE NECK OF A CONTAINER WITH A FIXING FLANGE

(75) Inventor: Didier Klodzinski, Canny-sur-Matz (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/926,119

(22) PCT Filed: Aug. 3, 2000

(86) PCT No.: PCT/FR00/00570

§ 371 (c)(1),
(2), (4) Date: Sep. 6, 2001

(87) PCT Pub. No.: WO00/53335

PCT Pub. Date: Sep. 14, 2000

(30) Foreign Application Priority Data

Mar. 8, 1999 (FR) ..... 99 02812

(51) Int. Cl.[7] ..... B65D 88/54
(52) U.S. Cl. ..... 222/321.7
(58) Field of Search ..... 222/321.1, 321.7, 222/321.9

(56) References Cited

U.S. PATENT DOCUMENTS 5,568,886 A * 10/1996 Knickerbocker
5,772,078 A * 6/1998 Knickerbocker ..... 222/321.1

* cited by examiner

*Primary Examiner*—Philippe Derakshani
*Assistant Examiner*—Thach H Bui
(74) *Attorney, Agent, or Firm*—Bacon & Thomas PLLC

(57) ABSTRACT

The invention provides a device for assembly a pump (P) on the neck (C) of a receptacle (R) having a retaining rim (A), the device being of the type comprising:

an inner bushing (1) fitting onto said neck (C) in leakproof manner, the top portion of the bushing being constituted by a collar (11) for supporting the pump (P) and its bottom portion being constituted by a retaining base (12) carrying at least one flexible anchor flap (10) which extends at least in part beneath said rim (A) of the receptacle; and an outer locking ring (2) for being engaged coaxially on said bushing (1) and providing radial clamping to ensure that at least the free end of said flap (10) is forced to press against the neck (C) of the receptacle, the device being characterized in that said flap (10) in the free state extends upwards, diverging at a small angle from a shoulder (14) formed on the base (12).

9 Claims, 3 Drawing Sheets

DEVICE FOR MOUNTING A PUMP ON THE NECK OF A CONTAINER WITH A FIXING FLANGE

The present invention relates to a device for assembling a pump on the neck of a receptacle having a retaining rim.

There already exist assembly devices as described in EP 0 290 431 of the type comprising:

an inner bushing fitting onto said neck in leakproof manner, the top portion of the bushing being constituted by a collar for supporting the pump, and its bottom portion being constituted by a retaining base carrying at least one flexible anchor flap which extends at least in part beneath said rim of the receptacle; and an outer locking ring for being engaged coaxially on said bushing and providing radial clamping to ensure that at least the free end of said flap is forced to press against the neck of the receptacle.

Unfortunately, such devices do not always provide sufficient mechanical strength, in particular when they are subjected to upwardly-directed traction forces.

In addition, those devices are not designed to be removable to allow the receptacle to be refilled.

Furthermore, the bottom portion of the ring is designed to come directly face-to-face with the wall of the receptacle. Unfortunately, given the variety of neck profiles, it is not always possible to ensure that the ring matches and co-operates with the neck in satisfactory manner.

In particular, a gap zone often appears between the bottom outline of the device and the neck of the receptacle, and this is harmful not only to appearance, but also to tamperproofing and sealing.

An object of the present invention is to resolve these technical problems in satisfactory manner.

According to the invention, this object is achieved by means of an assembly device of the above type characterized in that the flexible anchor flap in the free state extends upwards diverging at a small angle from a shoulder formed on the base.

According to an advantageous characteristic, said bushing has a top tube coaxial with said collar and provided with snap-fastening means for co-operating with complementary members formed in the inside wall of the ring.

In a particular embodiment, said snap-fastening members of the tube are constituted by a series of resiliently-deformable teeth.

In a variant, said complementary snap-fastening members of the ring are constituted by cavities facing said teeth and suitable for receiving them.

Preferably, said cavities are distributed as two superposed series, the bottom series corresponding to a premounting position, and the top series corresponding to a locking position.

Where appropriate, the two series of cavities are separated by a rib having inclined flanks, thereby guiding the teeth.

In another embodiment, said bushing has a self-sealing sleeve secured to the collar and designed to be engaged inside the neck of the receptacle, in contact with the inside wall thereof.

According to another advantageous characteristic, the inside wall of said ring has a chamfered bottom edge.

According to yet another characteristic, the device also includes a cover covering said ring.

The device of the invention can be mounted and locked in a manner that is simple and fast. It provides an assembly that is simultaneously strong, leakproof, and easily releasable, thus making it possible, optionally, to refill the receptacle.

In addition, the device can easily receive a cap and it is adaptable to numerous shapes of pump and receptacle.

The invention will be understood on reading the following description given with reference to the drawings, in which.

Figure 1:
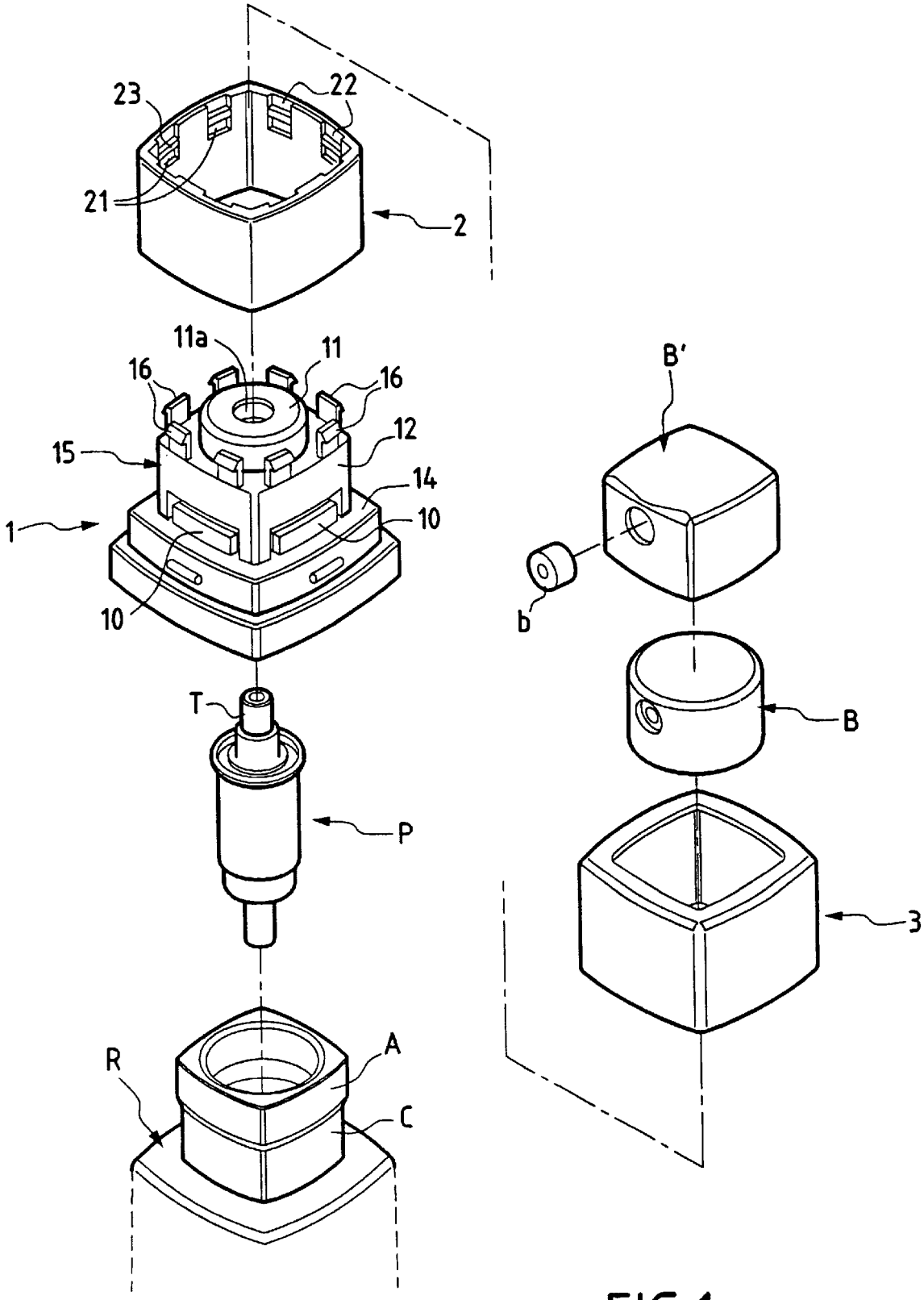
FIG. 1 is an exploded perspective view of an embodiment of the device of the invention.

The device shown in the figures is for assembling a pump P to the neck C of a receptacle R (not shown in full), which neck is provided with a retaining rim A.

The device comprises firstly an inner bushing 1 that fits over the neck C in leakproof manner, and secondly an outer locking ring 2 that co-operates with said bushing to secure the pump P in leakproof manner on the neck C. The ring 2 in this example is covered by a cover 3, e.g. made of aluminum.

The device as a whole possesses an envelope that is generally cylindrical, in this example being of section that is substantially square with rounded corners, however in a variant it is entirely possible to make the device so that its section is circular.

The bushing 1 has a top portion constituted by a collar 11 for supporting the pump P, and in its bottom portion by a retaining base 12.

The collar 11 is fitted to the body of the pump P and possesses an orifice 11*a* for receiving the delivery tube T of the pump P. The delivery tube T is fitted with a pushbutton B that is provided with a nozzle b, and possibly also with a covering B'.

In the embodiment shown, the top portion of the pump body is fixed to the inside of the collar 11, e.g. by snap-fastening or by clamping.

Nevertheless, in a variant, it is possible to provide for the pump body to be mounted via the outside of the collar 11.

The bushing 1 also has a self-sealing sleeve 13 (visible in FIGS. 2 and 3) forming part of the collar 11 and designed to be engaged in the neck C so as to make contact with its inside wall.

The retaining base 12 carries at least one flexible flap 10 for anchoring the base on the neck C, and in this example it carries four flaps 10 in two opposing pairs.

The flaps 10 extend at least in part beneath the rim A of the receptacle R and they extend upwards from a shoulder 14 formed on the base 12.

Figure 2:
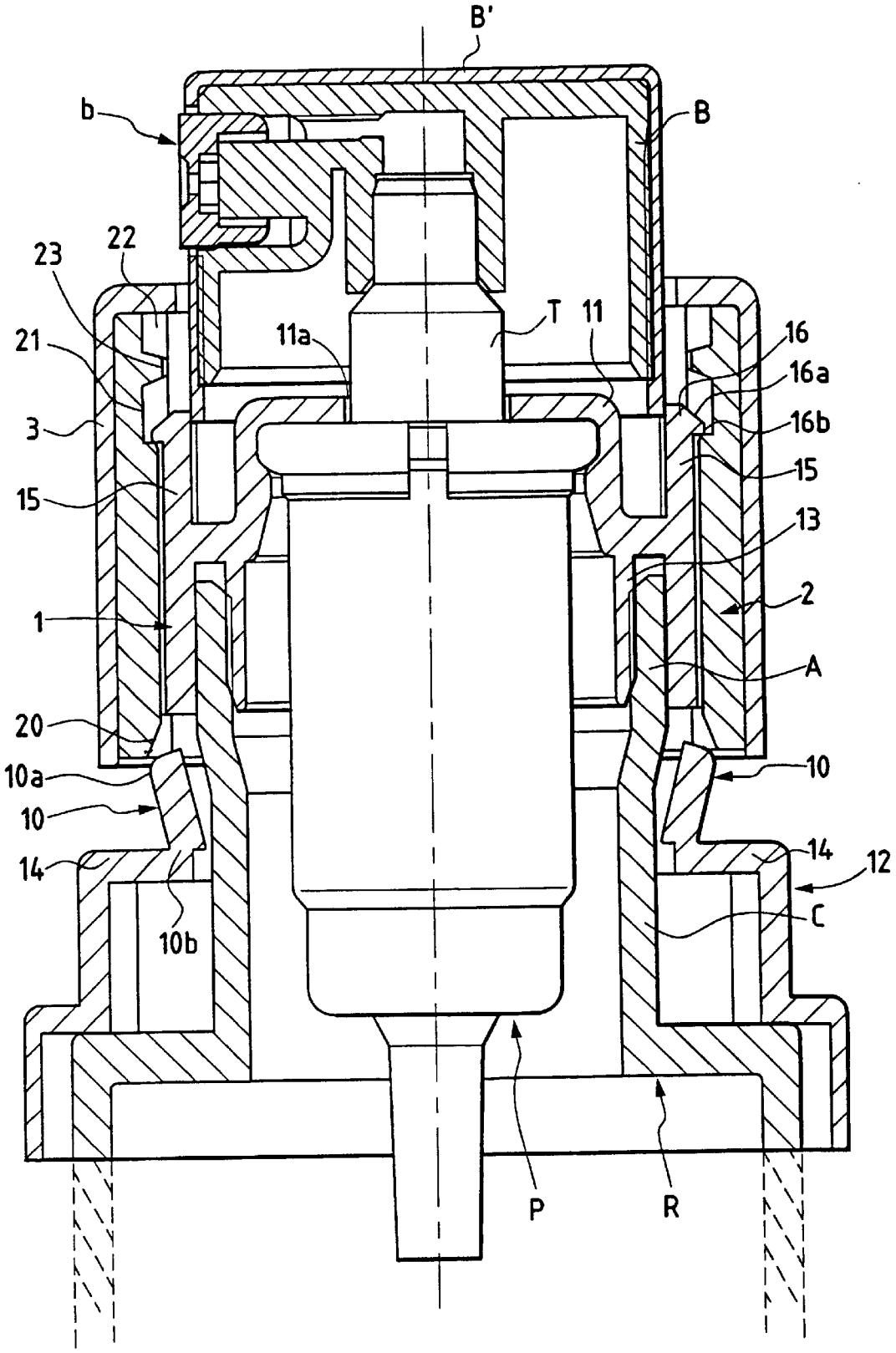
FIG. 2 is a section view showing the FIG. 1 embodiment in an initial stage during mounting.

When in the free state, as shown in the premounting position of FIG. 2, the flaps 10 slope at a small diverging angle and their ends 10*a* are thus oriented radially outwards.

The ends 10*a* have curvilinear outside profiles and straight-edged inside profiles, thus facilitating firstly guidance of the chamfered bottom edge 20 of the ring 2, and secondly anchoring beneath the bottom face of the retaining rim A of the receptacle R.

Figure 3:
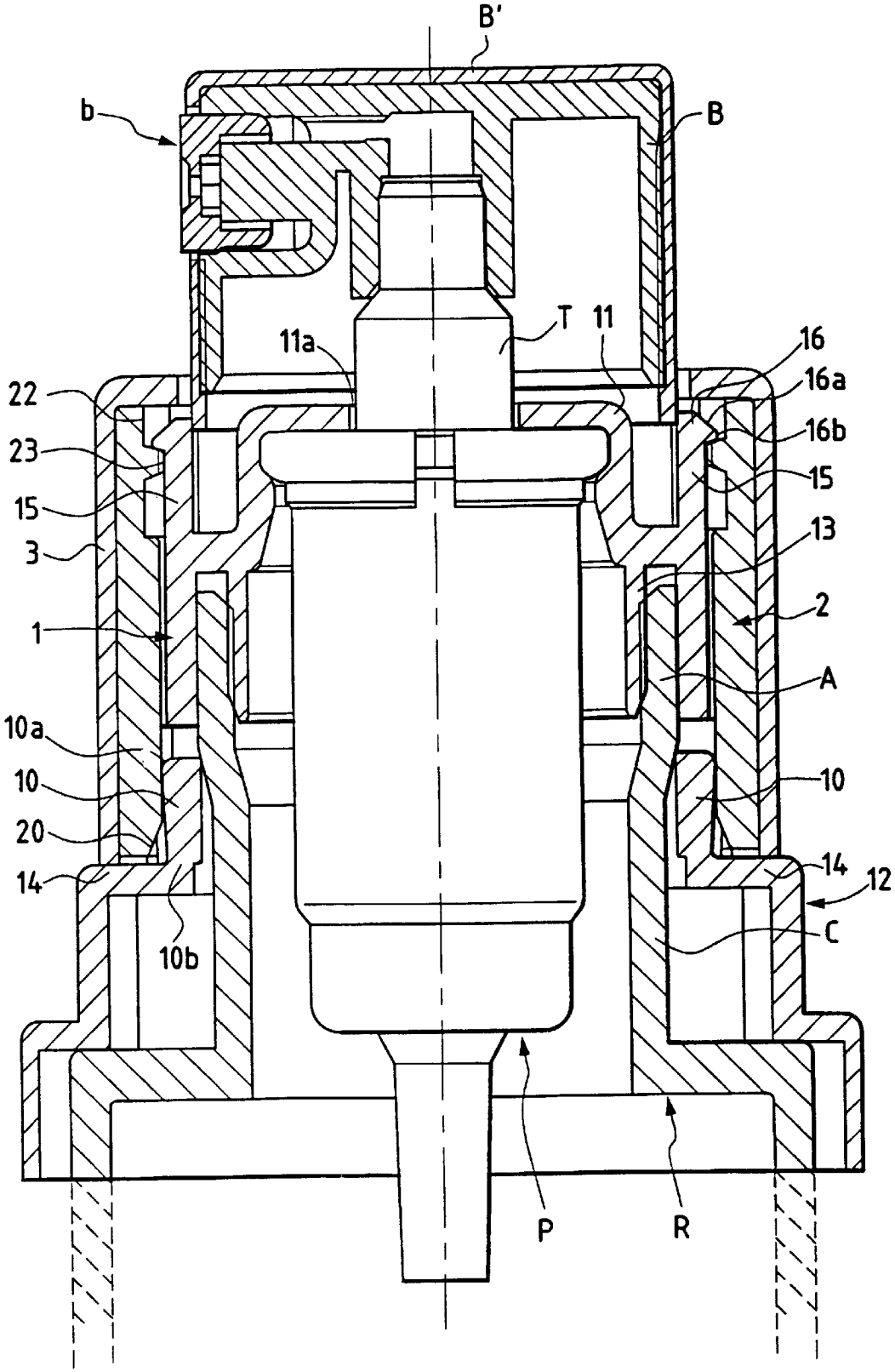
FIG. 3 is a section view of the FIG. 1 embodiment in the final stage of mounting.

The junction between the base of each flap 10 and the shoulder 14 is in the form of a hinge enabling said flap to move resiliently between a rest position when in the free state (FIG. 2), and its anchoring position when in a stressed state (FIG. 3).

This junction is preferably made via a narrowing 10*b* that guarantees flexibility to the flap 10.

The locking ring 2 is designed to be engaged coaxially on the bushing 1 and to provide radial clamping which forces and locks at least the free ends 10*a* of the flaps 10 against the neck C beneath the rim A.

The plane top face and edge of the end 10*a* of each flap which is thus pressed upwards against the bottom face of the retaining rim A which is optionally of complementary profile prevents the device being withdrawn by axial traction, even though the cylindrical variant retains a degree of freedom in rotation about the neck C.

The bushing 1 also includes a top tube 15 coaxial about the collar 11 and provided with snap-fastening members for co-operating with complementary members formed in the inside wall of the ring 2.

In the embodiment shown, these snap-fastening members are constituted by a series of resiliently deformable teeth 16 for being received in corresponding cavities formed in register therewith in the ring 2.

The cavities are organized as two superposed series 21, 22 with the bottom series 21 corresponding to the preassembly position (FIG. 2), and with the top series 22 corresponding to the locking position (FIG. 3).

The two series of cavities 21, 22 are separated by a rib 23 having sloping flanks and co-operating by guidance with a camming effect, in the upward direction with a sloping top face 16*a* formed on each tooth 16, and in the downward direction with the curved outlines 16*b* of said teeth.

The snap-fastening of the teeth 16 in the cavities is reversible and guarantees, for the top series 22, that the assembly has good mechanical strength while nevertheless making it easy to disassemble by passing into the bottom series 21 and releasing the flaps 10.

What is claimed is:

1. A device for assembly a pump (P) on the neck (C) of a receptacle (R) having a retaining rim (A), the device comprising:

an inner bushing (1) fitting onto said neck (C) in leakproof manner, the top portion of the bushing comprising a collar (11) supporting the pump (P) and its bottom portion comprising a retaining base (12) carrying at least one flexible anchor flap (10) which extends at least in part beneath said rim (A) of the receptacle and including a shoulder (14); and an outer locking ring (2) for being engaged coaxially on said bushing (1) and providing radial clamping to ensure that at least the free end of said flap (10) is forced to press against the neck (C) of the receptacle, said flap (10) in the free state extending upwards, diverging at a small angle from the shoulder (14).

2. The device according to claim 1, wherein said bushing (1) has a top tube (15) coaxial with said collar (11) and provided with snap-fastening device co-operating with complementary members formed in the inside wall of the ring (2).

3. The device according to claim 2, wherein said snap-fastening members of the tube (15) comprise a series of resiliently-deformable teeth (16).

4. The device according to claim 3, wherein said complementary snap-fastening members of the ring (2) comprise cavities (21, 22) facing said teeth (16) and being suitable for receiving said teeth.

5. The device according to claim 4, wherein said cavities are distributed as two superposed series, the bottom series (21) corresponding to a premounting position, and the top series (22) corresponding to a locking position.

6. The device according to claim 5, wherein the two series of cavities (21, 22) are separated by a rib (23) having inclined flanks.

7. The device according to claim 1, wherein said bushing (1) has a self-sealing sleeve (13) secured to the collar (11) and is configured to be engaged inside the neck (C) of the receptacle, in contact with the inside wall thereof.

8. The device according to claim 1, wherein an inside wall of said ring (2) has a chamfered bottom edge (20).

9. The device according to claim 1, further including a cover (3) covering said ring (2).

* * * * *